US010964172B1

(12) United States Patent
Baker

(10) Patent No.: US 10,964,172 B1
(45) Date of Patent: Mar. 30, 2021

(54) METHOD AND DEVICE FOR CONDUCTING A WAGERING GAME

(71) Applicant: Kenneth Baker, Las Vegas, NV (US)

(72) Inventor: Kenneth Baker, Las Vegas, NV (US)

( * ) Notice: Subject to any disclaimer, the term of this patent is extended or adjusted under 35 U.S.C. 154(b) by 0 days.

(21) Appl. No.: 16/879,472

(22) Filed: May 20, 2020

Related U.S. Application Data

(60) Provisional application No. 62/851,008, filed on May 21, 2019.

(51) Int. Cl.
*G07F 17/32* (2006.01)

(52) U.S. Cl.
CPC ..... *G07F 17/3293* (2013.01); *G07F 17/3211* (2013.01); *G07F 17/3244* (2013.01)

(58) Field of Classification Search
USPC ..... 463/11, 12, 13
See application file for complete search history.

(56) References Cited

U.S. PATENT DOCUMENTS 9,881,457 B2 * 1/2018 Kennedy ..... G07F 17/3293
2011/0111819 A1 * 5/2011 Moody ..... G07F 17/3293 463/13
2012/0142404 A1 * 6/2012 Moody ..... G07F 17/3293 463/13
2014/0378198 A1 * 12/2014 Kennedy ..... A63F 9/24 463/12
2016/0063805 A1 * 3/2016 Marks ..... G07F 17/3209 463/20
2017/0206741 A1 * 7/2017 Kennedy ..... G07F 17/3293
2018/0218570 A1 * 8/2018 Kennedy ..... G07F 17/3293

* cited by examiner

*Primary Examiner* — Pierre E Elisca
(74) *Attorney, Agent, or Firm* — FisherBroyles, LLP; Rob L. Phillips

(57) ABSTRACT

A method and device utilize a data processor and a player interface, display, and data storage device in communication with the data processor, A wager is received; optionally the wager includes a poker wager and a matrix wager. An initial hand is dealt and a poker hand is formed. Optionally, a poker hand consists of cards held from an initial hand plus replacements for cards discarded from an initial hand. The payout, if any, associated with the poker hand may be issued. A matrix is constructed by randomly placing value/suit combinations in matrix locations. Matrix locations containing value/suit combinations matching cards in the poker hand are marked. The payout, if any, associated with patterns formed in the matrix by marked matrix locations may be issued.

10 Claims, 5 Drawing Sheets

METHOD AND DEVICE FOR CONDUCTING A WAGERING GAME

FIELD OF THE INVENTION

The present invention relates to methods and devices for conducting wagering games. More particularly, the present invention is a method and device for conducting a wagering game in which a poker hand is conducted to determine a poker hand payout, a matrix containing randomly placed playing card indicia is marked based on the cards in the poker hand, and patterns in the matrix formed by marked matrix locations are examined to determine a matrix award.

BACKGROUND OF THE INVENTION

There are many games in which patterns appearing in a matrix are compared to a set of winning patterns to determine whether a player has won the game. One example of such a game is Bingo.

In Bingo a player buys a Bingo card which, in a typical game, consists of a 5×5 matrix of numbers arranged under columns identified by the letters B-I-N-G-O. In a conventional Bingo game, numbers can only appear in a designated column. For example, the numbers selected to appear in the "B" column of a Bingo card are randomly selected from the numbers 1-15. The numbers in the "I" column are randomly selected from the numbers 16-30; in the "N" column, the numbers are 31-45; in the "G" column, the numbers are 46-60; in the "0" column, the numbers are 61-75. A device, such as a hopper, blower, or random number generator, randomly selects balls. Each ball carries a Bingo indium of one column letter and a number associated with that column, e.g. B-12. If the column letter and number appear on the player's Bingo card, the coordinate where the letter/number combination appears on the card is marked. In a conventional Bingo game, the selection of balls continues until a player obtains a winning pattern of marked coordinates on his card. In this sense, each player competes against all other players in the game to be the first player to obtain a winning pattern. The player first obtaining a winning pattern is the winner of the game. In conventional Bingo, typical winning pattern are a column, row, diagonal, corners, or the like.

It is also known to apply a poker game to a Bingo game. For example, in U.S. Pat. No. 6,656,044, a player receives at least one Bingo card. As numbers are drawn, a playing card value is assigned to the Bingo number. For example, the Bingo number "B-15" may be assigned the playing card value "4♥". The result is that any player with a B-15 on his or her Bingo card obtains a 4♥ in the position of the B-15. Upon any player completing a predetermined pattern (such as five adjacent marked spots in a row, column, or diagonal of the Bingo card), the player's Bingo card is examined for patterns that may constitute a winning poker hand. For example, if a column of a player's Bingo card includes the cards 3♦, 4♥, 5♣, 6♣ and 7♦ the player would be rewarded for a straight.

SUMMARY OF THE INVENTION

A method and device are disclosed for conducting a game for a player. One such device is directed to an electronic gaming machine including a data processor in communication with a player interface, a data storage device, and a display. In an optional embodiment, the data storage device stores electronic representations of at least one deck of playing cards. It is contemplated that each playing card includes a value and a suit. The data storage device also stores an electronic representation of a matrix having a plurality of matrix locations, a poker pay table having poker hands correlated with payouts, a matrix pay table having patterns of matrix locations correlated with payouts, and program instructions executable by the data processor to execute a game.

In an optional embodiment, the program instructions include a method for conducting a wagering game. A wager is received from the player through the user interface. Optionally, the wager includes a poker wager and a matrix wager. In a further optional embodiment, the wager may include a plurality of matrix wagers. As discussed below, when a plurality of matrix wagers is received, each matrix wager may be associated with a separate matrix.

The data processor conducts a poker game for the player. In one such optional embodiment, the poker game includes the data processor dealing an initial hand of playing cards and displaying the initial hand at the display. A poker hand is formed using at least a portion of the initial hand. It is contemplated that the formation of the poker hand may include many different methods, such as the discarding and replacing of cards from the initial hand (as in draw poker), the use of the entire initial hand (as in five card stud), the use of a portion of the initial hand (as in seven-card stud), the use of community cards in combination with pocket cards or hole cards (as in hold'em poker), or any other method of formation. For example, in an optional embodiment directed to draw poker, the poker hand is formed by receiving selections from a player through a player interface to select playing cards in the initial hand to be discarded. The data processor deals a replacement playing card for each playing card discarded from the initial hand.

The data processor compares the poker hand to the poker pay table. As discussed above, the poker pay table includes poker hands correlated with payouts. It is contemplated that an optional embodiment may include conventional poker hands, such as Jacks or better, two pair, three of a kind, straight, flush, full house, four of a kind, straight flush, and royal flush. The data processor issues the payout, if any, associated with the poker hand according to the poker pay table. In an optional embodiment in which the wager includes a poker wager, the payout associated with the poker hand may be based on the poker wager.

The data processor randomly places value and suit combinations into a plurality of matrix locations in a matrix. In an optional embodiment, multiple matrices are used. As discussed above, a separate matrix may be used to resolve each in a plurality of matrix wagers.

After forming the poker hand, the data processor marks each matrix location having a value and suit combination matching the value and suit of each playing card in the poker hand. In a further optional embodiment, additional matrix locations may be marked, such as for cards in a stud poker hand or hold'em poker hand that are not used, cards discarded from a draw poker hand, or the like. Optionally, the matrix or matrices including the markings are displayed at the display.

The data processor compares the marked matrix locations with the matrix pay table. As discussed above, the matrix pay table includes patterns of matrix locations correlated with payouts. The data processor issues the payout, if any, associated with the pattern formed by the marked matrix locations according to the matrix pay table. In an optional embodiment in which the wager includes one or more matrix wagers, the payout associated with the patterns in the matrix or matrices hand may be based on the matrix wager associated with the matrix in which the pattern appears.

DESCRIPTION

Figure 4:
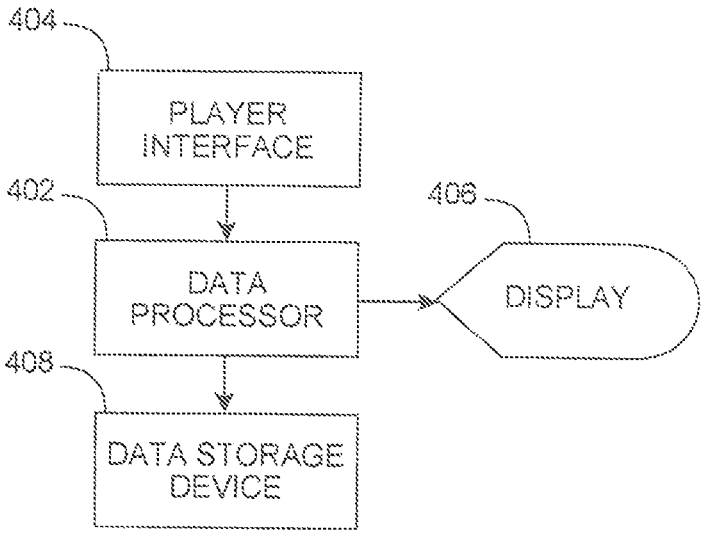
FIG. 4 is a block diagram of a device according to an embodiment of the present invention.
Figure 5:
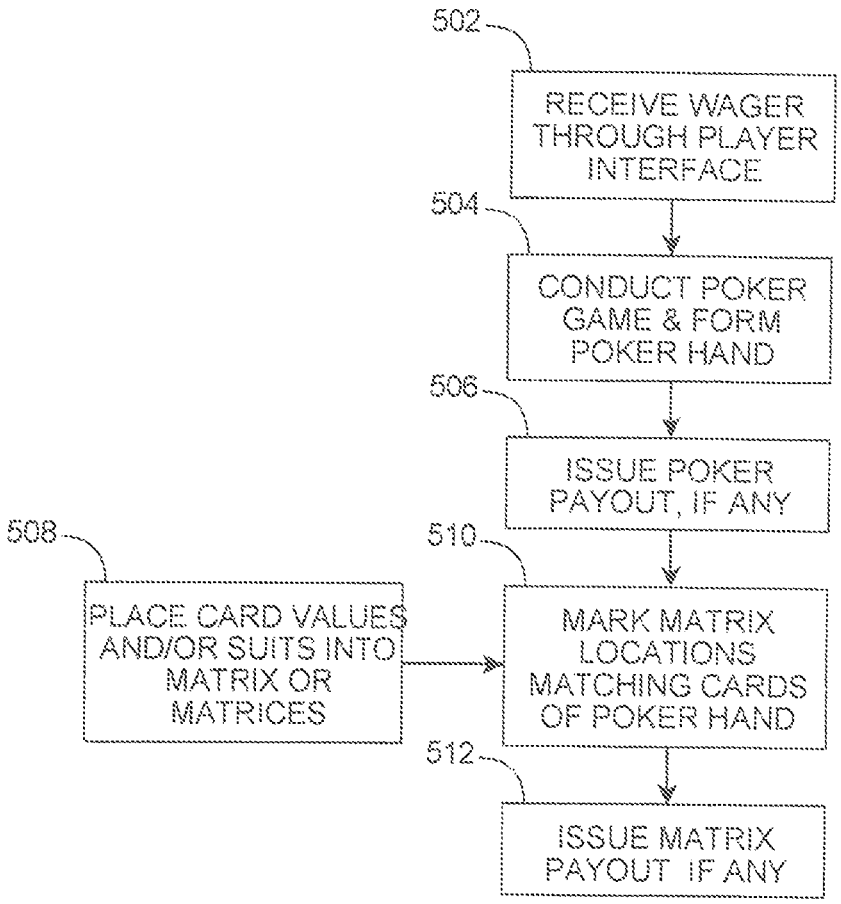
FIG. 5 is a flow chart of a method according to an embodiment of the present invention.

Reference is now made to the figures wherein like parts are referred to by like numerals throughout. Referring to FIGS. 4 and 5, the present invention includes methods and devices for conducting a wagering game. It is contemplated that the wagering game may be implemented in any form, including a live table game, an electronic game using an electronic device such as an electronic gaming machine, or the like. It is contemplated that an electronic gaming machine may include any form of device for conducting the wagering game, including a video card game machine, an electro-mechanical gaming machine, a slot machine, an electronic gaming table, a personal computer, a kiosk, a handheld device, a cellular telephone or personal digital assistant ("PDA"), or the like. Where the wagering game is implemented as a live table game, all or a portion of the steps of a method may be conducted by a live dealer, alone or with the aid of an electronic device. Thus, the description below of a method as carried out using an electronic gaming machine should be interpreted as illustrative rather than limiting since anyone or more of the steps described may be conducted by a live dealer with or without the assistance of an electronic gaming machine.

The present invention may include a device for conducting such a game method. For example, in one such optional embodiment shown in FIG. 4, the device is an electronic gaming machine with a data processor 402. The data processor 402 communicates with a player interface 404, a display 406, and a data storage device 40S. It is contemplated that a player interface 404 may include an input device. For example, the player interface 404 may include a button panel, keypad, keyboard, mouse, pointer, or the like. In one optional embodiment, the player interface 404 and the display 406 may be combined in a touchscreen device which would allow input through actuation of fields displayed on the display 406. In an optional embodiment, the player interface 404 may also include means for reading currency, coins, vouchers, tickets, microchips, cards, transmitters or transceivers, or other identifiers of value for the purpose of purchasing game credits for use in wagering. Similarly, the player interface 404 may include means for paying out rewards to a player and dispensing accrued game credits.

A display 406 may likewise take any form. For example, a display 406 may include a cathode ray tube ("CRT") monitor, a liquid crystal display ("LCD"), a plasma display, an organic light emitting diode ("OLED") display, or the like. As discussed above, a player interface 404 and a display 406 may be combined into a touchscreen device, such as a capacitive or resistive touchscreen device that includes a surface layer over a display to sense a touch on a displayed field and interpret the touch as input. The display 406 may be directly controlled by the data processor 402 or may be controlled via another device, such as a video controller, that is controlled by the data processor 402. It is noted that multiple displays may be provided. For example, in an optional embodiment, certain game information, such as a poker hand, may be displayed on one display, while other game information, such as a matrix or multiple matrices, may be displayed on a separate display. In such an optional embodiment, the displays may be separately controlled or controlled together through a shared data processor and/or video card.

A data storage device 408 may take any form, including optical storage, magnetic storage, flash memory, or the like. The data storage device 408 may store electronic representations of playing cards, each of which has a value and a suit. In an optional embodiment, the data storage device 408 may additionally store sound files, graphics files, animation files, parameters, and other information used in executing the program instructions. It is contemplated that the playing cards stored at the data storage device 408 may be conventional poker cards, that is, cards of four suits marked with values two through ten, jack, queen, king, and ace. It is further contemplated that the playing cards stored at the data storage device 408 may include a single conventional deck of playing cards, multiple conventional decks of playing cards, one or more truncated decks (such as a Spanish deck) of playing cards, one or more supplemented decks of playing cards (such as a conventional deck including one or more Jokers), or any variation or combination thereof It is contemplated that one or more of the playing cards may be designated wild cards which are capable of substituting for other playing cards. In an optional embodiment, the wild cards may substitute for any playing card, i.e. the wild card may assume any value and suit, or the wild cards may be limited in some way, i.e. substitute only for Aces or the like.

The data storage device 408 also stores a poker pay table. The poker pay table includes poker hands associated with payouts. The payouts may be fixed amounts, multiples of the poker wager, or the any other amount. Similarly, the poker hands included in the poker pay table may include any hands and may not necessarily be limited to conventional poker hands. An example of a poker pay table is shown below in Table 1. As may be appreciated, the poker hands and the associated payouts included in a poker pay table may vary in alternate optional embodiments.

TABLE 1

| Poker hand | Payout |
|---|---|
| Royal flush | 250:1 |
| Straight flush | 50:1 |
| Four of a kind | 25:1 |
| Full house | 9:1 |
| Flush | 6:1 |
| Straight | 4:1 |
| Three of a kind | 3:1 |
| Two pair | 2:1 |
| Jacks or better | 1:1 |

The data storage device 408 stores electronic representations of one or more matrices. The matrices may have any shape or size. In one optional embodiment, each matrix is a seven by eight array, i.e. a rectangular array with seven rows and eight columns, which results in fifty-six matrix locations. It is contemplated that the matrix size and shape may vary in alternate optional embodiments and need not be limited to regular or symmetrical shapes, but may include any regular, irregular, symmetrical, or asymmetrical shape. It is further contemplated that the shape and/or size may vary from game to game, or among matrices in a game including multiple matrices.

The data storage device 408 stores a matrix pay table. In the example shown in FIGS. 1-3, a single matrix pay table is shown. However, in a further optional embodiment, the data storage device 408 may store multiple matrix pay tables. For example, a different matrix pay table may be available for matrices of different size and/or shape. As discussed in greater detail below, matrix locations are marked on a matrix as a result of certain playing cards. A matrix pay table associates a payout with certain patterns of marked matrix locations. The payouts may be fixed amounts, multiples of the matrix wager or matrix wagers, or the like. Table 2 illustrates an example matrix pay table. It is contemplated that in alternate optional embodiments the patterns and/or the payouts associated therewith may vary.

TABLE 2

| Pattern | Payout |
|---|---|
| Four corners | 800:1 |
| Five in a row | 400:1 |
| Four in a box | 100:1 |
| Three corners | 40:1 |
| Four in a row | 15:1 |
| Two corners | 4:1 |
| Three in a box | 2:1 |
| Three in a row | 1:1 |

In the example of Table 2, a number of patterns are associated with payouts. For example, three in a row is formed when exactly three marked matrix locations appear in any linear relationship in the array, including a horizontal line, vertical line, or diagonal line as long as each marked matrix location lies along that line. Four in a row and five in a row are formed when exactly four marked matrix locations or five marked matrix locations, respectively, appear in any linear relationship in the array. In one optional embodiment, the marked matrix locations need not be adjacent to fulfill a three, four, or five in a row pattern. Three in a box and four in a box are formed when three adjacent marked matrix locations or four adjacent marked matrix locations, respectively, form an L, a reverse L, an inverted L, or an inverted and reversed L. Two corners is formed when exactly two of the corner matrix locations are marked. Three corners and four corners are formed when exactly three of the corner locations or four of the corner locations, respectively, are marked.

Figure 1:
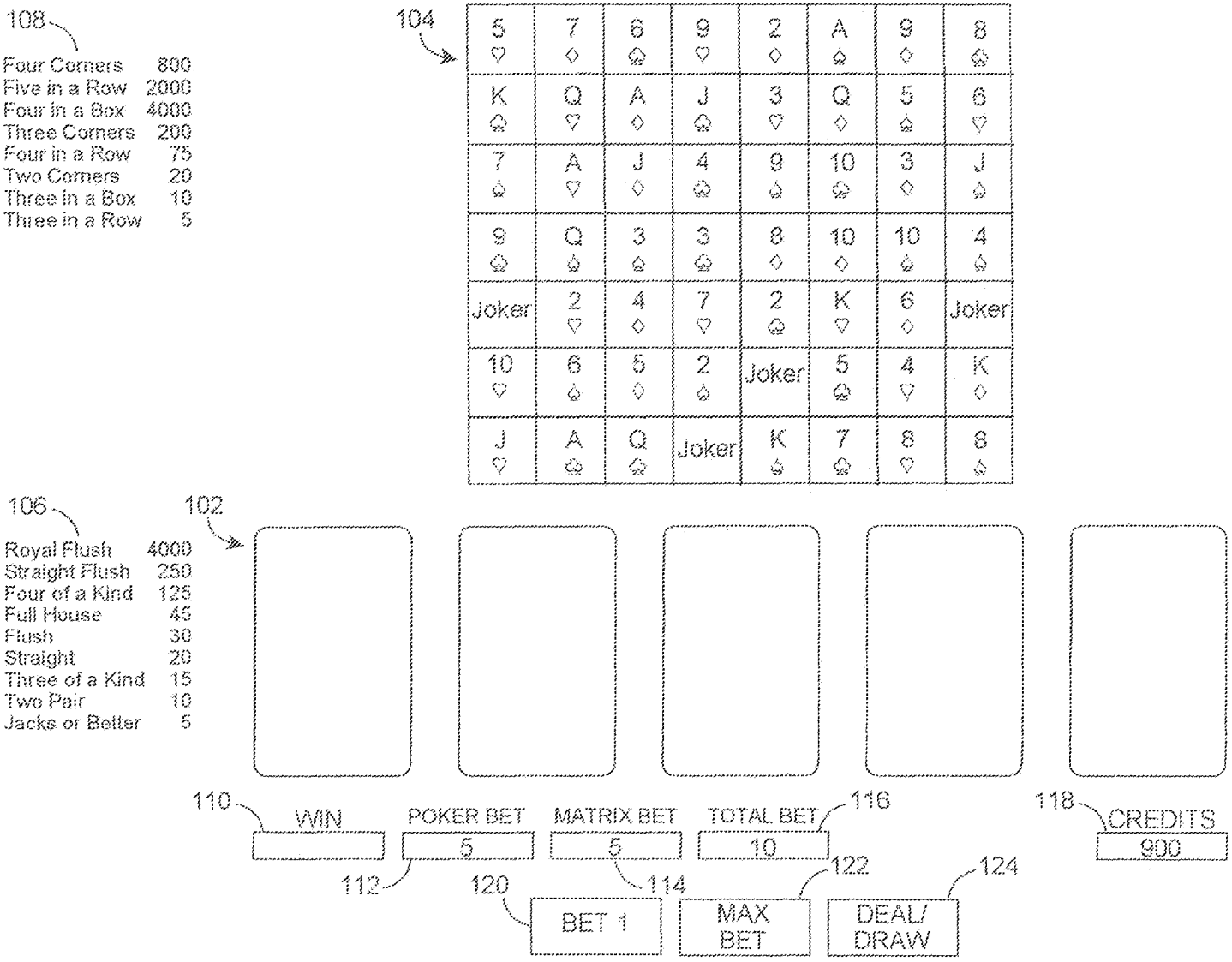
FIG. 1 is a front view of a screen shot of a device according to an embodiment of the present invention.
Figure 2:
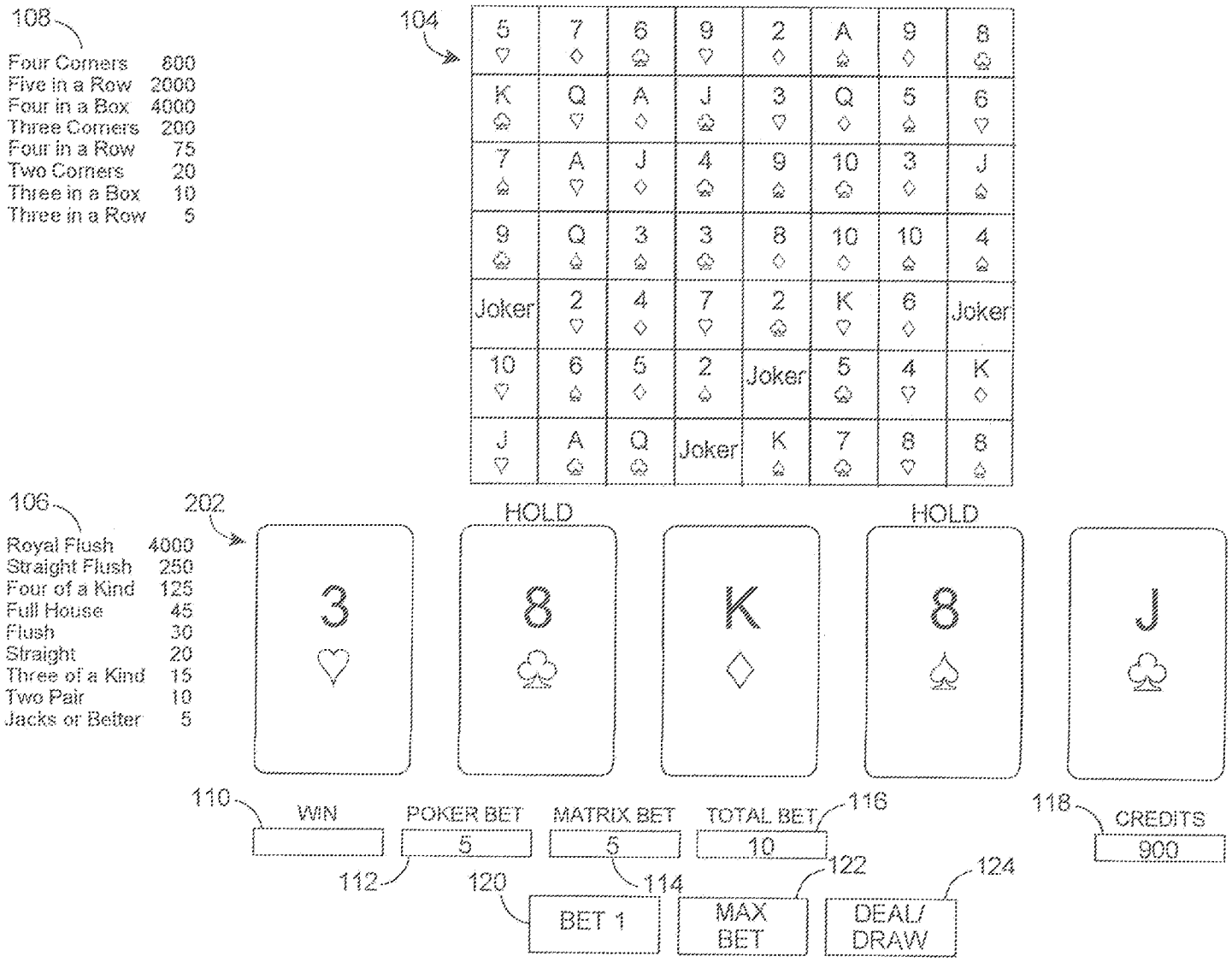
FIG. 2 is a front view of a screen shot of a device according to an embodiment of the present invention.
Figure 3:
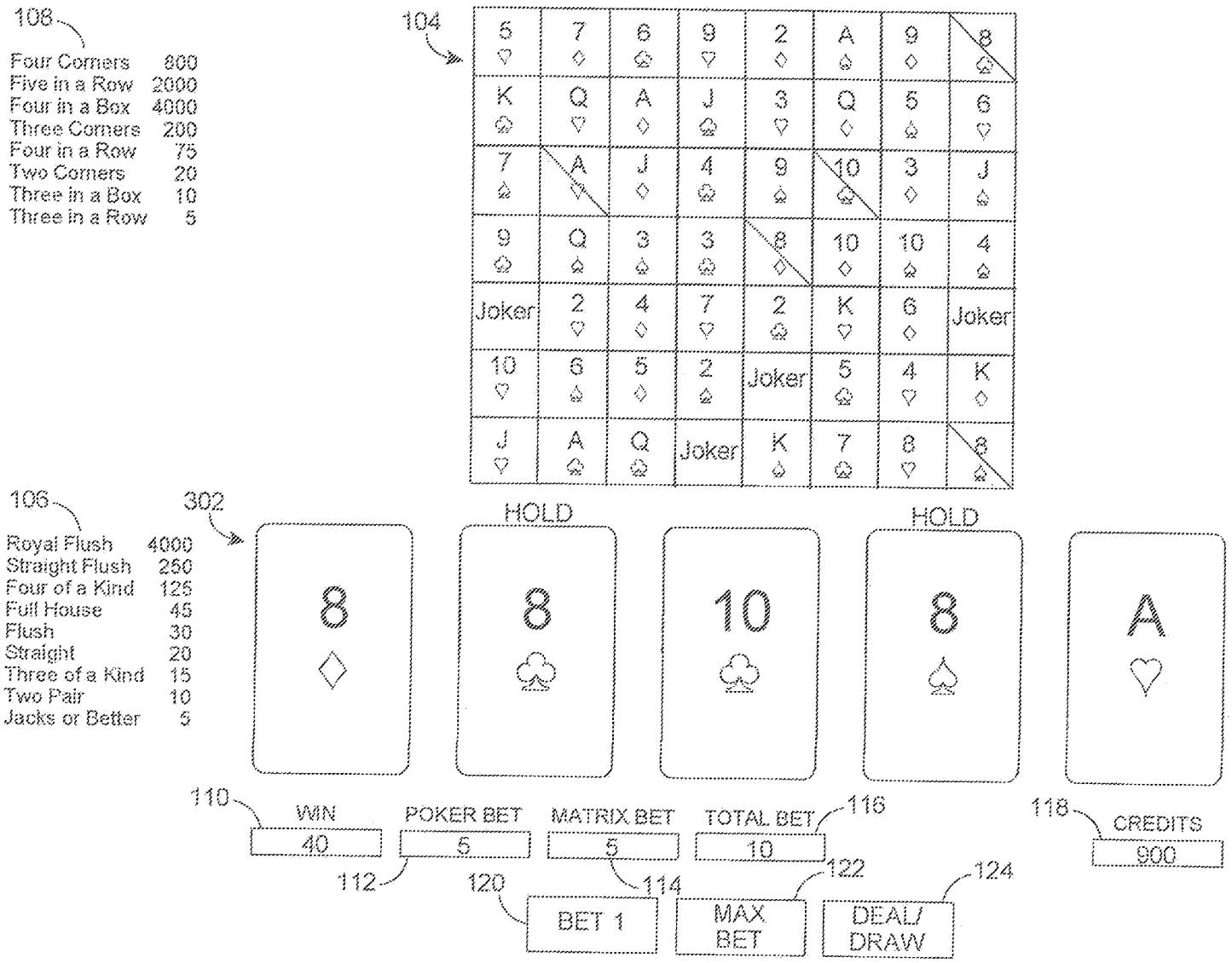
FIG. 3 is a front view of a screen shot of a device according to an embodiment of the present invention.

Referring to FIGS. 4 and 5, when such a device is used to execute a method, the data storage device 408 may also store program instructions executable by the data processor 402 to execute a method for conducting a game. In one such optional embodiment, the data processor 402 receives information from the player interface 404 indicating that a wager has been received 502 through the player interface 404. The wager may take the form of currency, coin, tickets, vouchers, cards, or the like being directly read by, or received through, the player interface 404. Alternatively, the wager may take the form of stored credits that are allocated by the player through input at the player interface 404. In the example of FIGS. 1-3, a player may allocate stored game credits to a hand wager through a "BET 1" button 120, "MAX BET" button 122, or the like that allocates a quantity of game credits to a wager when it is actuated.

Returning to FIGS. 4 and 5, in an optional embodiment, the wager may include two components. A wager may include a poker wager and at least one matrix wager. In such an optional embodiment, the poker wager may be resolved through a poker game (discussed in greater detail below) and the matrix wager or matrix wagers may be resolved through one or more matrices. For example, in an optional embodiment, a player may elect through the player interface 404 the number of matrices to include in the game. In one such optional embodiment, a separate matrix wager may be received for each matrix elected for the game. In an additional or alternate optional embodiment, a matrix wager may be received for a set of one or more matrices, with the wager applying to the entire set or being allocated to the matrices within the set.

In an alternate optional embodiment, the wager may include a single component, such as a wager on a poker hand or a wager on one or more matrices, with the other component of the game treated as a bonus or secondary game. For example, it is contemplated that a wager may be received for a poker hand, with a matrix game (discussed in greater detail below) serving as a bonus game or secondary game that does not require a separate wager. As may be appreciated, in one such optional embodiment, the matrix pay table of such a bonus game may be more limited in the patterns associated with payouts. In an additional or alternative embodiment, the matrix game may be contingent upon a trigger, such a random trigger, an outcome in the poker game, or the like.

A poker hand is conducted 504 for a player. In one optional embodiment, an initial hand is dealt and, in an optional embodiment, displayed to the player. In an optional embodiment utilizing a device, a data processor 402 may include or communicate with a random number generator (or may execute software to provide a random number generator) that randomly generates a number associated with a playing card, or a combination of playing cards, to be dealt among to the initial hand. The data processor 402 may also control the display 406 to display the initial hand to the player.

The initial hand may take any form. For example, in an optional embodiment based on five-card draw poker, the initial hand consists of five playing cards. Similarly, in an optional embodiment based on hold'em poker, the initial hand consists of two playing cards. It is contemplated that the initial hand may have any composition based on the poker game being conducted.

A poker hand is formed based on the initial hand. In certain embodiments, no additional steps are needed to form the initial hand into a poker hand. For example, where the device conducts a poker game of five card stud, the five cards dealt to the initial hand form the five-card poker hand. In other embodiments, input may be received from the player to form the poker hand. For example, where the device conducts a poker game of five card draw, zero, some, or all of the five cards dealt to the initial hand may be selected to be discarded. In yet other embodiments, the poker hand may incorporate later dealt cards, community (or shared) cards, or the like. For example, in an optional embodiment based on hold'em poker, the initial hand may include two cards. Five community cards may be dealt, with the poker hand comprising the highest ranking five-card poker hand from the seven cards available.

In an optional embodiment, the poker hand is compared to the poker pay table and the payout, if any, associated with the poker hand is issued 506 to the player. As suggested above, it is contemplated that in an alternate optional embodiment, the poker hand may merely serve as a trigger for a matrix game and may not necessarily be associated with a wager and/or a pay table. Nevertheless, the example includes wagers for both a poker game and a matrix game and pay tables for both a poker game and a matrix game.

Value and suit combinations are placed 508 into the matrix or matrices. In an optional embodiment, the value and suit combinations are represented as playing cards. Thus, as shown in FIGS. 1-3, the matrix 104 may include playing card value/suit combinations at the various matrix locations. In an optional embodiment, the playing card value/suit combinations are placed randomly into the matrix locations.

With reference generally to FIGS. 4 and 5, optionally, the value/suit combinations are obtained from the deck of playing cards used to conduct the poker game, such that each playing card in the deck used to conduct the poker game is placed into each matrix. For example, in an optional embodiment in which the poker game is conducted with a single conventional fifty-two card deck, the matrix or matrices may include seven rows and eight columns for fifty-six matrix locations (i.e. 7×8=56). The four extra matrix locations could be treated in any manner. In one optional embodiment, cards from the deck may be duplicated so that each matrix location includes a card from the deck (with forty-eight cards each occupying one matrix location and four cards each occupying two matrix locations). In another optional embodiment, extra matrix locations may be occupied by place holders that are free spots, i.e. are considered marked in every game. That is, in such an optional embodiment, one or more of the extra matrix locations may be marked regardless of the cards in the poker hand (as discussed below). In yet another optional embodiment, one or more of the extra matrix locations may be considered an unplayable or dead spot, i.e. considered unmarked in every game. That is, in such an optional embodiment, one or more of the extra matrix locations may be unmarked in every game regardless of the cards in the poker hand (as discussed below). It is contemplated that these, or other variations may be mixed or combined in any optional embodiment. Moreover, the treatment of extra matrix locations may dynamically change in the course of a game or from game to game.

While not illustrated, it is also contemplated that the matrix may include fewer matrix locations than the number of cards in the deck used to deal the poker game. For example, a poker game may be dealt from a conventional fifty-two card poker deck but the matrix may be a five by five matrix similar to that used in conventional Bingo. In an optional embodiment, the cards in the poker hand may be guaranteed to appear in the matrix, although the exact location of the cards may not be determined. That is, in an optional embodiment, the twenty-five matrix locations in a five by five matrix may include the value/suit identifiers corresponding to the cards in the poker hand, plus twenty other (possibly randomly selected) cards from the deck. In an alternate optional embodiment in which the number of matrix locations is fewer than the number of cards in the deck, all the cards placed into the matrix locations are randomly selected, with the cards of the poker hand neither more nor less likely to appear in a matrix location than any other card. For example, where the matrix includes twenty-five matrix locations, in one optional embodiment, all twenty-five playing card value/suit combinations placed into a five by five matrix may be randomly selected so that the matrix may include all, some, or none of the cards in the poker hand.

As discussed above, it is contemplated that the present invention may include multiple matrices. It is contemplated that the matrices may be identical, similar, or dissimilar. That is, the player may be presented with multiple identical matrices, multiple matrices that share some common features (such as including the same value/suit combinations, but in different positions), multiple dissimilar matrices, or the like. In one such optional embodiment, each matrix has the same value/suit combinations but the placement of those combinations in the matrix locations is randomly determined for each matrix. Thus, while it is possible that duplicate matrices may be constructed, it is highly unlikely. In a further optional embodiment, the program instructions may prevent duplicate matrices from being randomly constructed by comparing matrices and replacing duplicates.

In an optional embodiment, the matrix locations, if any, which include a suit/value combination corresponding to a card in the poker hand are marked 510. For example, in an optional embodiment in which a poker hand includes five cards, five matrix locations, or, in alternate optional embodiments, up to five matrix locations, may be marked. In the example of FIGS. 1-3, as explained in greater detail below, the poker hand 302 includes the cards 8♦, 8♣, 10♣, 8♠ and A♠ and, thus the matrix locations corresponding to those cards are marked.

Referring generally to FIGS. 4 and 5, in an optional embodiment, additional matrix locations may also be marked. For example, in an optional embodiment directed to hold'em poker, the poker hand may consist of five cards out of seven available cards (two player cards plus five community cards). In one optional embodiment, matrix locations with suit/value combinations corresponding to all seven of the available cards may be marked, regardless of which five cards were incorporated into the poker hand. Similarly, in an optional embodiment directed to draw poker, matrix locations may be marked only for the five cards in the poker hand or, in an alternate optional embodiment, for the five cards in the poker hand plus cards dealt to the initial hand that were discarded. It is contemplated the scope of the present invention may include many other variations with respect to which matrix locations are marked.

As discussed above, multiple matrices may be provided. In such an optional embodiment, matrix locations may be marked on each matrix. It is contemplated that the various matrices may be different in size, shape, composition, or any other feature, or they may share a common size, shape, composition, and/or any feature. Similarly, it is contemplated that each matrix may be associated with a different matrix pay table. For example, the matrix pay table may vary in pattern, payouts, or both, with respect the size or shape of the matrix. The matrix or matrices may also be marked using the same cards or using different cards. For example, in a game based on draw poker, one matrix may be marked with the five cards of the poker hand, while another matrix is marked with the five cards of the poker hand plus any cards dealt to the initial hand that were discarded. Alternatively, each matrix may be marked only with the cards of the poker hand.

The patterns formed by the marked matrix locations on each matrix are compared to the matrix pay table for that matrix and the payout or payouts, if any, associated with the pattern of marked matrix locations is issued 512. In an optional embodiment, a player may only receive a single payout, such as the highest payout, for a pattern, even if the matrix contains multiple patterns associated with a payout. In an alternate optional embodiment, a player may receive multiple payouts if the matrix contains multiple patterns associated with a payout. In yet another optional embodiment, certain payouts may be considered subsets of other payouts and thereby may not result in being treated as separate payouts, while others are treated separately.

As discussed above, in an optional embodiment, multiple matrices may be marked. In one such optional embodiment, each matrix is associated with a separate matrix wager. Optionally, such an optional embodiment would include the player receiving a separate payout for each matrix that includes a pattern on the matrix pay table associated with that matrix.

Stepping through an example game, as shown in FIGS. 1-3, a wager is received from a player. As discussed above, the wager may be allocated from stored game credits. For example, in FIGS. 1-3, the player's stored game credits that are available to wager or cash out may be shown in a "CREDITS" field 118. In the example illustrated, the player wagers ten credits, with five credits allocated to a poker wager and five credits allocated to a matrix wager. In the example, the poker wager is shown in a "POKER BET" field 112 and the matrix wager is shown in a "MATRIX BET" field 114. Optionally, the wager may be shown as well. In the optional embodiment of FIGS. 1-3, the wager is shown in a "TOTAL BET" field 116. In this example, the device only makes one matrix available to the player, or the device has received an election from the player to use one matrix, and, therefore, only a single matrix is shown. However, as discussed above, multiple matrices may be available to, or elected by, the player in alternate optional embodiments.

This example is based on five-card draw poker dealt from a single conventional poker deck of fifty-two cards. Thus, the initial hand consists of five cards. In an initial screen, such as that shown in FIG. 1, the cards may be unexposed (e.g. patterns representing card backs may be displayed) or the cards may be undealt (e.g. blank spaces 102 representing where the cards will be dealt may be displayed).

In the example of FIG. 2, the initial hand 202 is dealt and displayed to the player and includes 3♥, 8♣, K♦, 8♠ and J♣. As may be understood, the device receives an election from the player to hold (or discard, depending on the embodiment) none, some, or all the cards of the initial hand in favor of replacement cards. As illustrated in FIG. 2, the device receives an election from the player through the player interface to hold the cards 8♣ and 8♠. In the example illustrated, a prompt may be received that the player has completed his or her elections through a "DEAL/DRAW" button 124.

Replacement cards are dealt for the three cards not elected to be held. As illustrated in FIG. 3, the replacement cards include 8♦, 10♣ and A♠ for a poker hand 302 of 8♦, 8♣, 10♣, 8♠ and A♠. The poker hand 302 is compared to the poker pay table 106. In this example, the poker hand 302 contains "three of a kind" by virtue of the three cards having a value of eight. According to the example poker pay table 106, a five credit wager is rewarded at 3:1 for a payout of fifteen credits.

In this example, the fifty-two cards of the poker deck used to deal the poker game are arranged into the matrix locations of a seven by eight matrix 104, with four matrix locations containing "joker" indicia. As discussed above, the significance of the "joker" indicia may vary from embodiment to embodiment. In this case, the joker signifies a matrix location that is ineligible to be marked, i.e. the joker locations in this embodiment cannot be marked regardless of the cards in the poker hand. As discussed above, in alternate optional embodiments, the joker locations may be regular matrix locations that are marked when a joker card is dealt, free matrix locations that are always marked, or any variation thereon.

Matrix locations are marked. In this example, matrix locations are marked for each matrix location containing a card in the poker hand 302. That is, five matrix locations are marked with each matrix location corresponding to one of the five cards in the poker hand 302. In alternate optional embodiments, more or fewer matrix locations may be marked. Referring to FIG. 3, matrix locations corresponding to the cards 8♦, 8♣, 10♣, 8♠ and A♠ are marked.

The patterns formed by the marked matrix locations in the matrix 104 are compared to the matrix pay table. Referring to FIG. 3, marked matrix locations form two patterns, three in a row (along a diagonal line) and two corners. In an optional embodiment, the payout includes the individual payouts for each pattern. Based on the matrix pay table 108, and the player's five credit matrix wager, the payout is twenty-five credits (twenty for two corners plus five for three in a row). Optionally, the total payout from the poker game and the matrix may be shown in a "WIN" field 110. In the example of FIG. 3, the total payout is forty credits (i.e. fifteen credits from the poker game plus twenty-five credits from the matrix game).

While certain embodiments of the present invention have been shown and described it is to be understood that the present invention is subject to many modifications and changes without departing from the spirit and scope of the invention presented herein.

I claim:

1. A method for conducting a game for a player using an electronic gaming machine including a data processor in communication with a player interface, a data storage device, and a display, said data storage device storing electronic representations of at least one deck of playing cards wherein each playing card has a value and a suit, an electronic representation of a matrix having a plurality of matrix locations, a poker pay table having poker hands correlated with payouts, a matrix pay table having patterns of matrix locations correlated with payouts, and program instructions executable by said data processor to execute a game, the method comprising:

receiving a wager from said player through said user interface;

said data processor conducting a poker game for said player comprising:

said data processor dealing an initial hand of playing cards and displaying said initial hand at said display; forming a poker hand starting with said initial hand;

said data processor comparing said poker hand to said poker pay table; and said data processor issuing the payout, if any, associated with said poker hand according to said poker pay table;

said data processor randomly placing value and suit combinations into a plurality of matrix locations in a matrix;

after forming said poker hand, said data processor marking each matrix location having a value and suit combination matching the value and suit of each playing card in said poker hand, and displaying said matrix including said markings at said display; said data processor comparing said marked matrix locations with said matrix pay table; and said data processor issuing the payout, if any, associated with said pattern formed by said marked matrix locations according to said matrix pay table.

2. The method of claim 1 wherein said step of forming a poker hand using at least a portion of said initial hand comprises:

receiving input from said player through said player interface to discard zero or more playing cards from said initial hand; and said data processor dealing a replacement playing card for each playing card discarded from said initial hand.

3. The method of claim 1 wherein said step of receiving a wager comprises receiving a poker wager and a matrix wager such that said payout associated with said poker hand is based on said poker wager and said payout associated with said pattern formed by said marked matrix locations is based on said matrix wager.

4. The method of claim 3 wherein said wager includes a plurality of matrix wagers, said method further comprising:

said data processor randomly placing value and suit combinations into a plurality of matrix locations in a plurality of matrices such that each matrix wager is associated with a different matrix;

said data processor comparing said marked matrix locations in each matrix with said matrix pay table; and said data processor issuing the payout, if any, associated with said pattern formed by said marked matrix locations in each matrix according to said pay table based on the matrix wager associated with the matrix.

5. A method for conducting a game for a player using an electronic gaming machine including a data processor in communication with a player interface, a data storage device, and a display, said data storage device storing electronic representations of at least one deck of playing cards wherein each playing card has a value and a suit, an electronic representation of a matrix having a plurality of matrix locations, a poker pay table having poker hands correlated with payouts, a matrix pay table having patterns of matrix locations correlated with payouts, and program instructions executable by said data processor to execute a game, the method comprising:

receiving a wager from said player through said user interface, said wager including a poker wager and at least one matrix wager;

said data processor conducting a poker game for said player comprising said data processor dealing an initial hand of playing cards and displaying said initial hand at said display;

forming a poker hand starting with said initial hand;

said data processor comparing said poker hand to said poker pay table; and said data processor issuing the payout, if any, associated with said poker hand according to said poker pay table based on said poker wager;

said data processor randomly placing value and suit combinations into a plurality of matrix locations in one or more matrices such that each matrix wager is associated with a different matrix;

after forming said poker hand, said data processor marking each matrix location in each matrix having a value and suit combination matching the value and suit of each playing card in said poker hand, and displaying said one or more matrices including said markings at said display;

said data processor comparing said marked matrix locations in each matrix with said matrix pay table; and said data processor issuing the payout, if any, associated with said pattern formed by said marked matrix locations in each matrix according to said matrix pay table based on said matrix wager associated with said matrix.

6. The method of claim 5 wherein said step of forming a poker hand using at least a portion of said initial hand comprises:

receiving input from said player through said player interface to discard zero or more playing cards from said initial hand; and said data processor dealing a replacement playing card for each playing card discarded from said initial hand.

7. A device for conducting a game for a player comprising:

a data processor;

a player interface in communication with said data processor;

a display in communication with said data processor; and a data storage device in communication with said data processor, storing electronic representations of at least one deck of playing cards wherein each playing card has a value and a suit, an electronic representation of a matrix having a plurality of matrix locations, a poker pay table having poker hands correlated with payouts, a matrix pay table having patterns of matrix locations correlated with payouts, and program instructions executable by said data processor to execute a game, the program instructions comprising:

receiving a wager from said player through said user interface;

said data processor conducting a poker game for said player comprising:

said data processor dealing an initial hand of playing cards and displaying said initial hand at said display;

forming a poker hand starting with said initial hand;

said data processor comparing said poker hand to said poker pay table; and said data processor issuing the payout, if any, associated with said poker hand according to said poker pay table;

said data processor randomly placing value and suit combinations into a plurality of matrix locations in a matrix;

after forming said poker hand, said data processor marking each matrix location having a value and suit combination matching the value and suit of each playing card in said poker hand, and displaying said matrix including said markings at said display;

said data processor comparing said marked matrix locations with said matrix pay table; and said data processor issuing the payout, if any, associated with said pattern formed by said marked matrix locations according to said matrix pay table.

8. The device of claim 7 wherein said step of forming a poker hand using at least a portion of said initial hand in said program instructions executable by said data processor further comprises:

receiving input from said player through said player interface to discard zero or more playing cards from said initial hand; and said data processor dealing a replacement playing card for each playing card discarded from said initial hand.

9. The device of claim 7 wherein said step of receiving a wager in said program instructions executable by said data processor comprises receiving a poker wager and a matrix wager such that said payout associated with said poker hand is based on said poker wager and said payout associated with said pattern formed by said marked matrix locations is based on said matrix wager.

10. The device of claim 9 wherein said program instructions executable by said data processor further comprises:

said data processor randomly placing value and suit combinations into a plurality of matrix locations in a plurality of matrices such that each matrix wager is associated with a different matrix;

said data processor comparing said marked matrix locations in each matrix with said matrix pay table; and said data processor issuing the payout, if any, associated with said pattern formed by said marked matrix locations in each matrix according to said pay table based on the matrix wager associated with the matrix.

* * * * *